US010325712B2

(12) United States Patent
Shudarek

(10) Patent No.: US 10,325,712 B2
(45) Date of Patent: Jun. 18, 2019

(54) ADJUSTABLE INTEGRATED COMBINED COMMON MODE AND DIFFERENTIAL MODE THREE PHASE INDUCTORS WITH INCREASED COMMON MODE INDUCTANCE AND METHODS OF MANUFACTURE AND USE THEREOF

(71) Applicant: MTE Corporation, Menomonee Falls, WI (US)

(72) Inventor: Todd A. Shudarek, West Bend, WI (US)

(73) Assignee: MTE Corporation, Menomonee Falls, WI (US)

( * ) Notice: Subject to any disclaimer, the term of this patent is extended or adjusted under 35 U.S.C. 154(b) by 0 days.

(21) Appl. No.: 15/487,910

(22) Filed: Apr. 14, 2017

(65) Prior Publication Data

US 2017/0301452 A1 Oct. 19, 2017

Related U.S. Application Data

(60) Provisional application No. 62/322,520, filed on Apr. 14, 2016.

(51) Int. Cl.

| | |
|---|---|
| ***H01F 27/26*** | (2006.01) |
| ***H01F 27/255*** | (2006.01) |
| ***H01F 1/147*** | (2006.01) |
| ***H01F 27/32*** | (2006.01) |

(52) U.S. Cl.

CPC ..... *H01F 27/266* (2013.01); *H01F 1/14791* (2013.01); *H01F 27/255* (2013.01); *H01F 27/325* (2013.01)

(58) Field of Classification Search

CPC . H01F 3/14; H01F 37/00; H01F 27/24; H01F 30/14; H01F 17/00; H01F 17/04; H01F 38/38; H01F 27/266; H02M 1/126; H03H 7/01

USPC ..... 333/185; 336/10

See application file for complete search history.

(56) References Cited

U.S. PATENT DOCUMENTS

| | | | | |
|---|---|---|---|---|
| 7,768,373 | B2 * | 8/2010 | Shudarek | H01F 3/10 336/212 |
| 9,613,745 | B2 * | 4/2017 | Shudarek | H01F 3/14 |

* cited by examiner

*Primary Examiner* — Benny T Lee
*Assistant Examiner* — Hafizur Rahman
(74) *Attorney, Agent, or Firm* — Greenberg Traurig, LLP

(57) ABSTRACT

In some embodiments, the instant invention involves an electrical system that at least includes: a three-phase inductor, including: a core, including: a plurality of core lamination pieces. having: a first core lamination piece and a second core lamination piece; where the first core lamination piece includes a plurality of first laminations that have a first shape and arranged in a first pattern to form a plurality of first differential mode gaps; where the second core lamination piece includes a plurality of second laminations that have a second shape and arranged a second pattern to form a plurality of second differential mode gaps; where the first pattern and the second pattern are distinct; where the first core lamination piece and the second core lamination piece are positioned at a particular orientation of the first pattern to the second pattern so that to increase a common mode inductance of the core.

18 Claims, 7 Drawing Sheets

ADJUSTABLE INTEGRATED COMBINED COMMON MODE AND DIFFERENTIAL MODE THREE PHASE INDUCTORS WITH INCREASED COMMON MODE INDUCTANCE AND METHODS OF MANUFACTURE AND USE THEREOF

RELATED APPLICATIONS

This application claims priority of U.S. Provisional Appln. Ser. No. 62/322,520, filed Apr. 14, 2016, entitled "ADJUSTABLE INTEGRATED COMBINED COMMON MODE AND DIFFERENTIAL MODE THREE PHASE INDUCTORS WITH INCREASED COMMON MODE INDUCTANCE AND METHODS OF MANUFACTURE AND USE THEREOF," which is incorporated herein by reference in its entirety for all purposes.

TECHNICAL FIELD

In some embodiments, the instant invention relates to three phase inductors and methods of manufacture and use thereof.

BACKGROUND

Typically, a three phase inductor has both common mode and differential mode magnetic flux paths that overlap and circulate around the center of the core construction. Typically, a three phase inductor is constructed from three core segments.

SUMMARY OF INVENTION

In some embodiments, the instant invention can provide an electrical system that at least includes the following: at least one three-phase inductor, including: at least one core, including: a plurality of core lamination pieces; where the plurality of core lamination pieces includes: at least one first core lamination piece and at least one second core lamination piece; where the at least one first core lamination piece includes a plurality of first laminations that have at least one first shape and that are arranged in at least one first pattern to form a plurality of first differential mode gaps; where the at least one first shape is configured such the at least one first pattern is configured to allow to independently adjust a thickness of each first differential mode gap from a thicknesses of each other first differential mode gap of the plurality of first differential mode gaps; where the at least one second core lamination piece includes a plurality of second laminations that have at least one second shape and that are arranged in at least one second pattern to form a plurality of second differential mode gaps; where the at least one second shape of the plurality of second laminations is configured such the at least one second pattern is configured to allow to independently adjust a thickness of each second differential mode gap from a thicknesses of each other second differential mode gap of the plurality of second differential mode gaps; where the at least one first pattern is distinct from the at least one second pattern; and where the at least one first core lamination piece and the at least one second core lamination piece are positioned next to each at a particular orientation of the at least one first pattern to the at least one second pattern so that to increase a common mode inductance of the at least one core.

In some embodiments, the plurality of core lamination pieces are configured to form at least one first core segment, at least one second core segment, and at least one third core segment; the at least one three-phase inductor further includes: at least one first coil bobbin being around the at least one first core segment, at least one second coil bobbin being around the at least one second core segment, at least one third coil bobbin being around the at least one third core segment; and the at least one first coil bobbin, the at least one second coil bobbin, and the at least one third coil bobbin are configured to be independently manufactured from the plurality of core lamination pieces.

In some embodiments, the electrical system is a Sinewave filter.

In some embodiments, the electrical system is a harmonic mitigating filter.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION OF SOME EMBODIMENTS

Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive. Any alterations and further modifications of the inventive feature illustrated herein, and any additional applications of the principles of the invention as illustrated herein, which would normally occur to one skilled in the relevant art and having possession of this disclosure, are to be considered within the scope of the invention.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, "high permeability" means a magnetic permeability that is at least 1000 times greater than the permeability of air, and "low permeability" means a magnetic permeability that is less than 100 times the permeability of air.

In some embodiments, the present invention is directed to devices having at least one inductor core, being constructed as an integrated common mode/differential mode three phase inductor core with adjustable differential mode inductance and increased common mode inductance.

Figure 1:
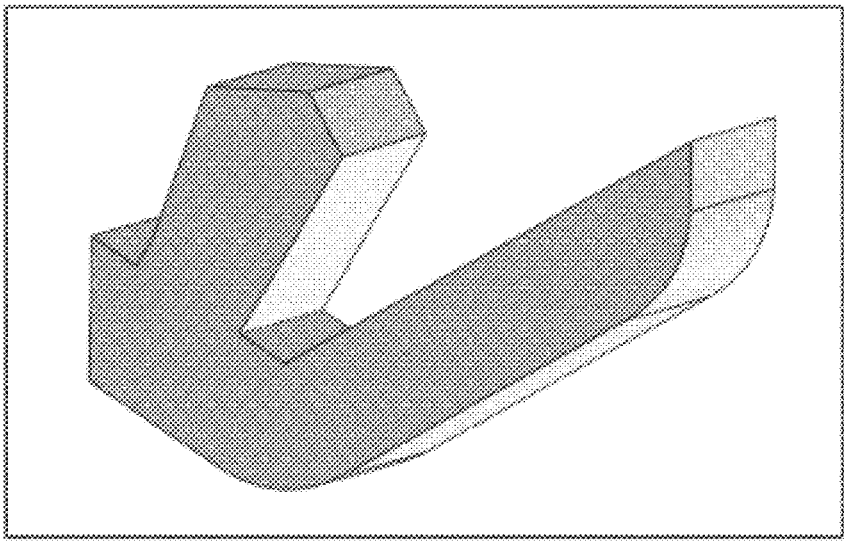
FIGS. 1-9 are snapshots that illustrate certain aspects of the instant invention in accordance with some embodiments of the instant invention.
Figure 2:
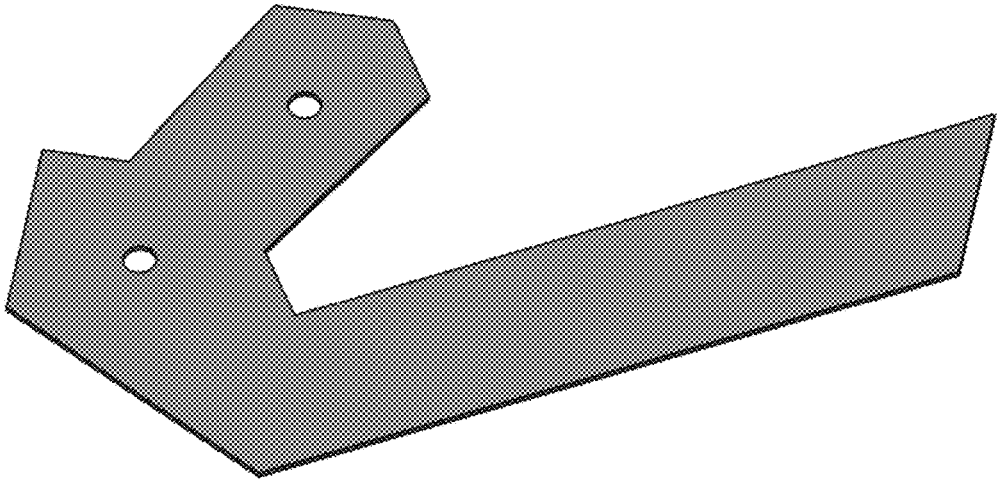
Figure 3:
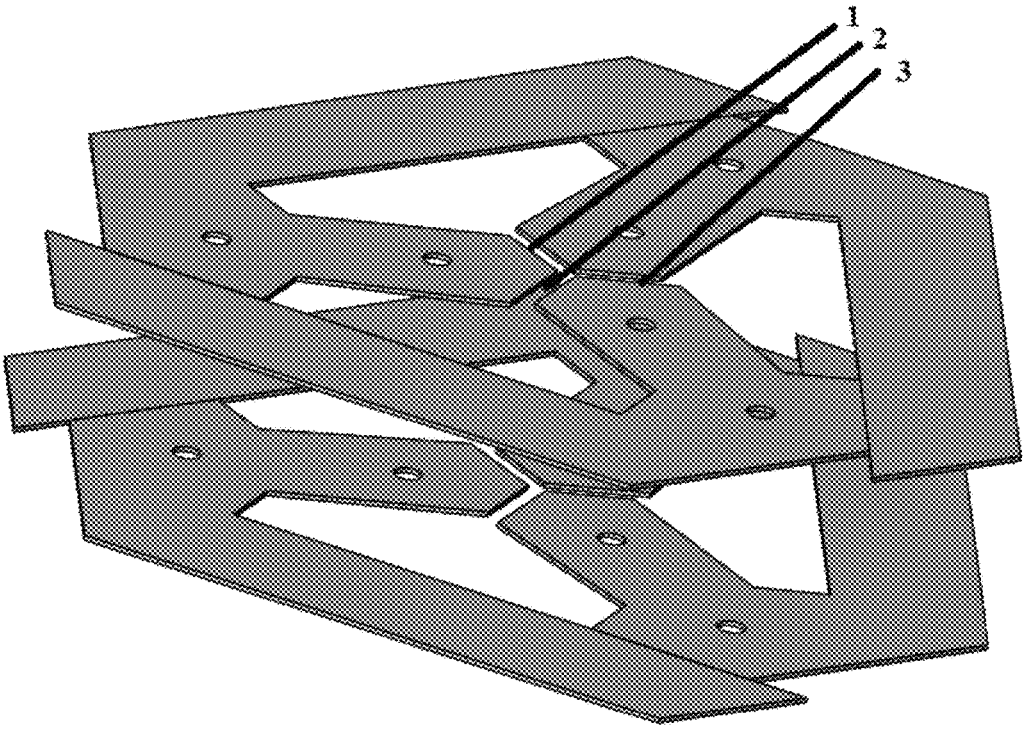

In some embodiments, in accordance with the present invention each core shape described in U.S. Pat. Pub. No. 20150102882, to Shudarek ("Shudarek 20150102882"), as for example, but not limited to, shown in FIG. 1, can be constructed from a plurality of laminations which are interleaved to increase the common mode inductance. The specific disclosures of the induction core design and construction in ("Shudarek 20150102882") are hereby incorporated herein for all purposes. For example, FIG. 2 shows an exemplary single lamination which is representative of a plurality of laminations which can be utilized to construct the illustrative core piece of FIG. 1. In some embodiments, the exemplary inventive core laminations of the present invention can be interleaved in groups of one or more laminations to change the common mode inductance. For example, FIG. 3 shows an exploded view of an illustrative stacking alternate pattern of core lamination pieces (i.e., each core lamination piece is made from the plurality of laminations) with a first type of differential mode gaps 1, 2, 3; and stacked one lamination per group. In some embodiments, the thickness of each of differential mode gaps 1, 2, and 3 can independently vary from 0.05 to 0.25 inches. In some embodiments, the thickness of each of the differential mode gaps 1, 2, and 3 can independently vary from 0.1 to 0.25 inches. In some embodiments, the thickness of each of the differential mode gaps 1, 2, and 3 can independently vary from 0.15 to 0.25 inches. In some embodiments, the thickness of each of the differential mode gaps 1, 2, and 3 can independently vary from 0.1 to 0.2 inches.

Figure 4:
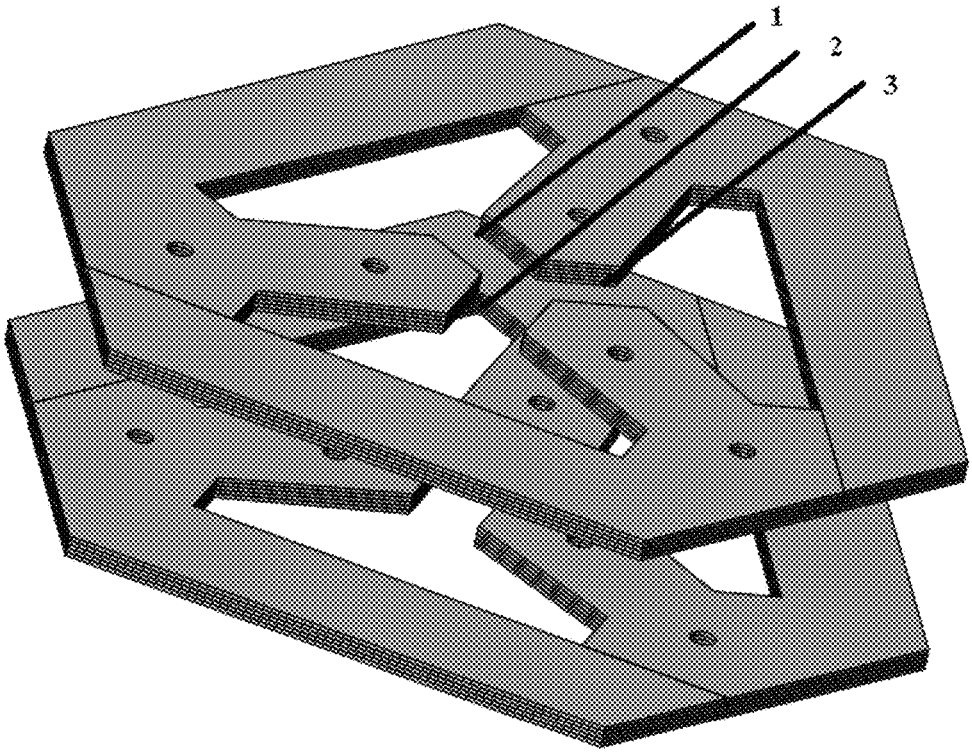

For example, FIG. 4 shows an exploded view of another illustrative stacking alternate pattern of core lamination pieces (i.e., each core lamination piece is made from the plurality of interleaved laminations) with a second type of differential mode gaps 1, 2, 3; and stacked five laminations per group. In some embodiments, the thickness of each of the differential mode gaps 1, 2, and 3 in FIG. 4 can independently vary from 0.25 to 1.5 inches. In some embodiments, the thickness of each of the differential mode gaps 1, 2, and 3 in FIG. 4 can independently vary from 0.25 to 1 inches. In some embodiments, the thickness of each of the differential mode gaps 1, 2, and 3 in FIG. 4 can independently vary from 0.5 to 1.5 inches. In some embodiments, the thickness of each of the differential mode gaps 1, 2, and 3 in FIG. 4 can independently vary from 1 to 1.5 inches.

In some embodiments, a change in differential mode inductance is based, at least in part, on a shape of each lamination. For example, the present invention allows to increase the common mode inductance based on interleaving the core structure made of a plurality of core lamination pieces (i.e., each core lamination piece is made from the plurality of interleaved laminations) so that an effective non-magnetic gap in the common mode flux path is reduced. In some embodiments, the exemplary inventive core structure based on the plurality of core lamination pieces (i.e., each core lamination piece is made from the plurality of interleaved laminations) allows to achieve a maximum common mode inductance and still have an adjustable differential mode inductance.

Figure 5:
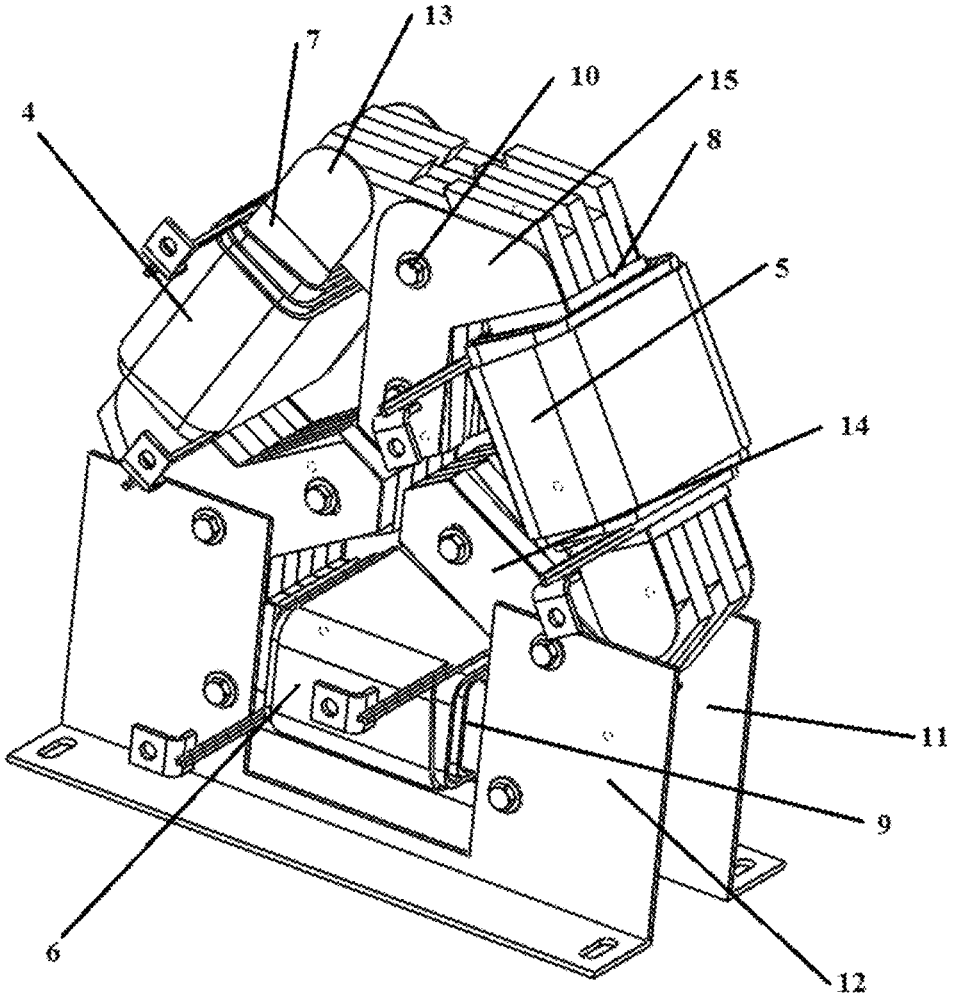

FIG. 5 shows an exemplary construction of the exemplary inventive induction core in accordance with some embodiments of the present invention. For example, the exemplary inventive induction core can have three coils that are wound with suitable winding materials such as, but not limited to, a copper or aluminum magnet wire, insulated copper foil, one other similarly suitable material, and any combination thereof. For example, the inventive construction can have at least one insulation material such as, but not limited to, Dupont Nomex material, insulating the exemplary inventive induction core from coils 7, 8, 9. For example, as shown in FIG. 5, there can be two mounting brackets made such as those shown 11, 12. For example, as shown in FIG. 5, the inventive induction core can be held together by numerous nuts, bolts, and/or washer such as, but not limited to, located at 10. For example, as shown in FIG. 5, the inventive induction core can be held together with a pre-determined number of tie straps. For example, as shown in FIG. 5, there can be 6 tie straps, three in the front (13, 14, 15) and three in the back.

Figure 6:
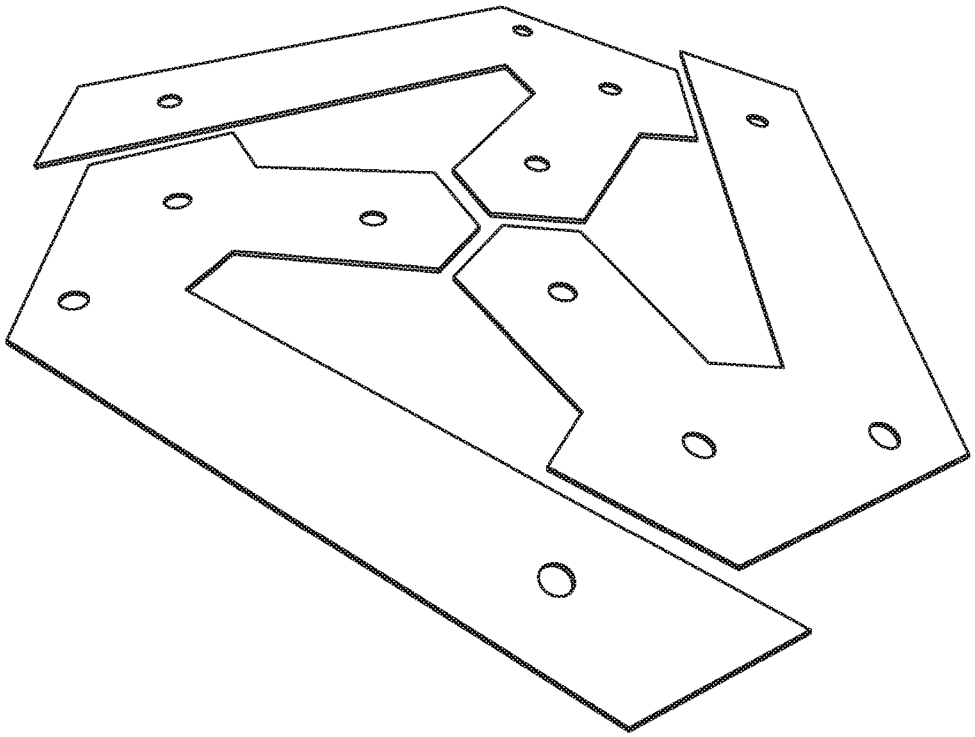

FIG. 6 shows additional exemplary laminations utilized in the construction of the inventive induction core in accordance with the principles of the present invention.

Figure 7:
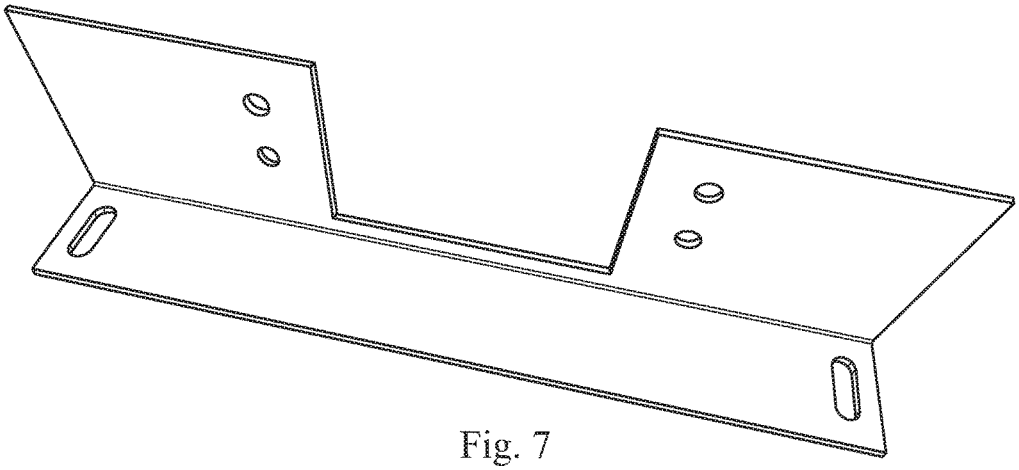

FIG. 7 shows an exemplary mounting bracket utilized in the construction of the inventive induction core in accordance with the principles of the present invention.

Figure 8:
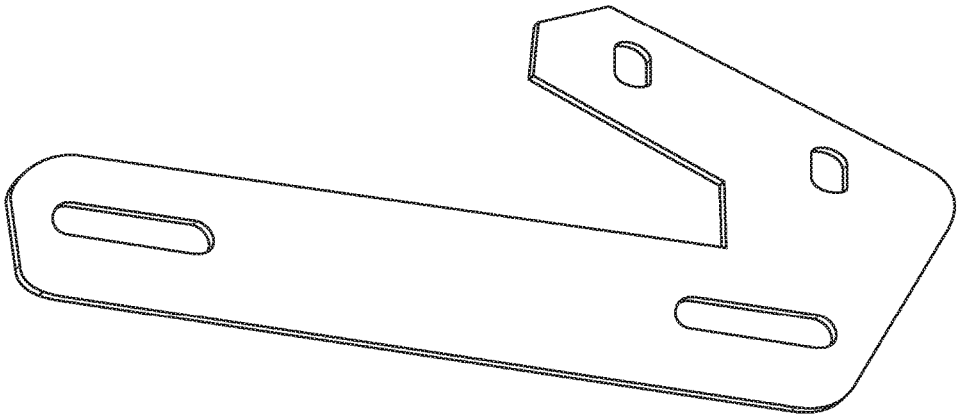

FIG. 8 shows an exemplary tie strap utilized in the construction of the inventive induction core in accordance with the principles of the present invention.

Figure 9:
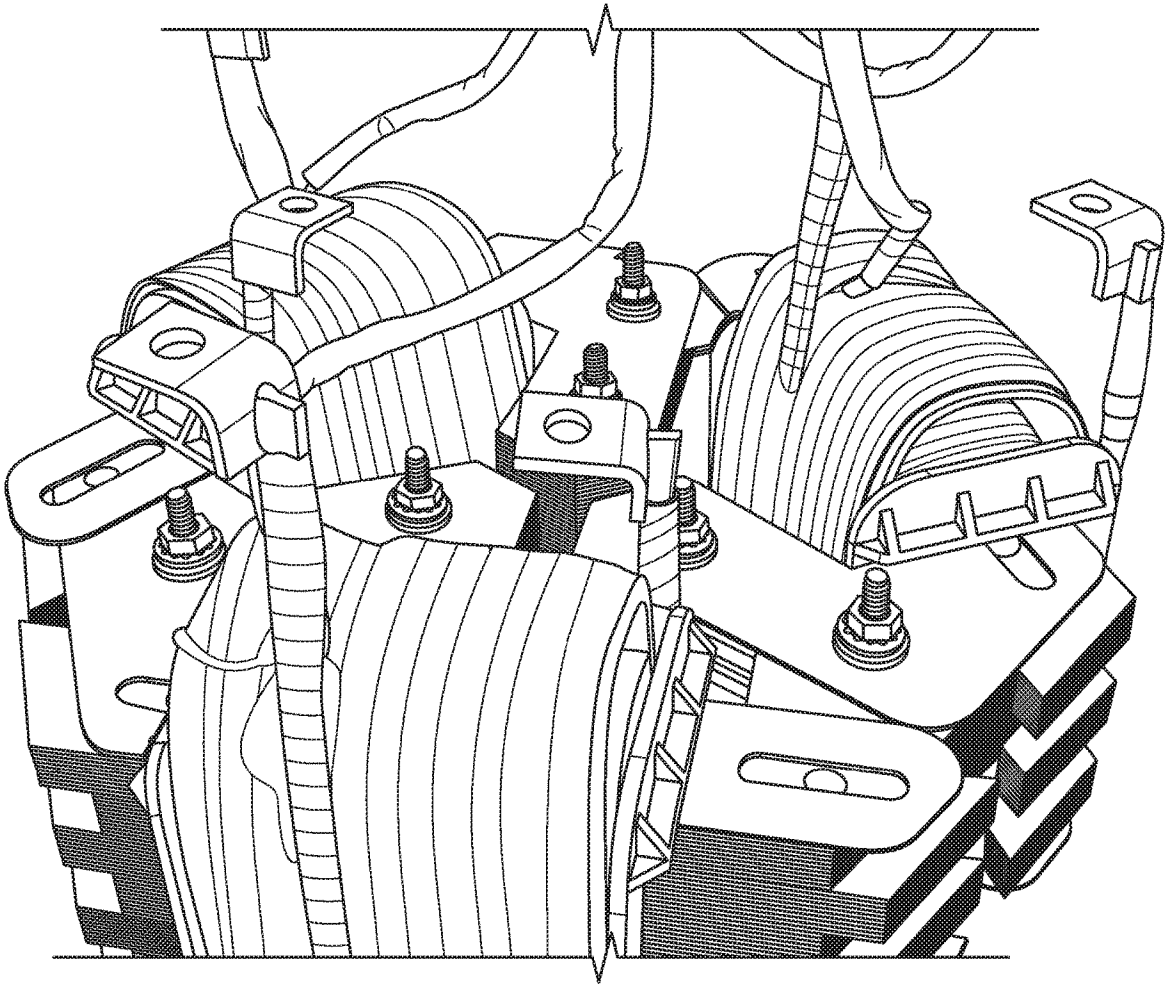

FIG. 9 shows an exemplary core assembly of the inventive induction core in accordance with the principles of the present invention. The exemplary core assembly of FIG. 9 is shown with bobbin wound coils and no mounting bracket.

In some embodiments, the exemplary inventive inductive core of the present invention can be utilized in, for example but not limited to, power conversion devises such as described in U.S. Pat. No. 8,653,931 to Zu, whose specific disclosures of such devices is hereby incorporated herein by reference.

In some embodiments, the exemplary inventive inductive core of the present invention can be utilized in, for example but not limited to, applications such as described in U.S. Patent Pub. No. 20150102882 to Shudarek, whose specific disclosures of such applications is hereby incorporated herein by reference.

In some embodiments, the instant invention can provide an electrical system that at least includes the following: at least one three-phase inductor, including: at least one core, including: a plurality of core lamination pieces; where the plurality of core lamination pieces includes: at least one first core lamination piece and at least one second core lamination piece; where the at least one first core lamination piece includes a plurality of first laminations that have at least one first shape and that are arranged in at least one first pattern to form a plurality of first differential mode gaps; where the at least one first shape is configured such the at least one first pattern is configured to allow to independently adjust a thickness of each first differential mode gap from a thicknesses of each other first differential mode gap of the plurality of first differential mode gaps; where the at least one second core lamination piece includes a plurality of second laminations that have at least one second shape and that are arranged in at least one second pattern to form a plurality of second differential mode gaps; where the at least one second shape of the plurality of second laminations is configured such the at least one second pattern is configured to allow to independently adjust a thickness of each second differential mode gap from a thicknesses of each other second differential mode gap of the plurality of second differential mode gaps; where the at least one first pattern is distinct from the at least one second pattern; and where the at least one first core lamination piece and the at least one second core lamination piece are positioned next to each at a particular orientation of the at least one first pattern to the at least one second pattern so that to increase a common mode inductance of the at least one core.

In some embodiments, the at least one first core lamination piece includes a plurality of stacked first core lamination pieces.

In some embodiments, the at least one second core lamination piece includes a plurality of stacked second core lamination pieces.

In some embodiments, at least one first core lamination piece includes a plurality of stacked first core lamination pieces; and the at least one second core lamination piece includes a plurality of stacked second core lamination pieces.

In some embodiments, each lamination of the plurality of first laminations has a distinct shape.

In some embodiments, each lamination of the plurality of first laminations has the same shape.

In some embodiments, each lamination of the plurality of second laminations has a distinct shape.

In some embodiments, each lamination of the plurality of second laminations has the same shape.

In some embodiments, each lamination of the plurality of first laminations is made from at least one material selected from the group consisting of powered iron, molypermalloy, ferrite, steel, and sendust.

In some embodiments, each lamination of the plurality of second laminations is made from at least one material selected from the group consisting of powered iron, molypermalloy, ferrite, steel, and sendust.

In some embodiments, the thickness of each first differential mode gap of the plurality of first differential mode gaps varies from 0.05 to 1.5 inches.

In some embodiments, the thickness of each first differential mode gap of the plurality of first differential mode gaps varies from 0.5 to 0.25 inches.

In some embodiments, the thickness of each second differential mode gap of the plurality of second differential mode gaps varies from 0.05 to 1.5 inches.

In some embodiments, the thickness of each second differential mode gap of the plurality of second differential mode gaps varies from 0.5 to 0.25 inches.

In some embodiments, each first differential mode gap of the plurality of first differential mode gaps is filed with at least one of: air, Nomex, a fiberglass-reinforced thermoset polyester, or any combination thereof.

In some embodiments, each second differential mode gap of the plurality of second differential mode gaps is filed with at least one of: air, Nomex, a fiberglass-reinforced thermoset polyester, or any combination thereof.

In some embodiments, the plurality of core lamination pieces are configured to form at least one first core segment, at least one second core segment, and at least one third core segment; the at least one three-phase inductor further includes: at least one first coil bobbin being around the at least one first core segment, at least one second coil bobbin being around the at least one second core segment, at least one third coil bobbin being around the at least one third core segment; and the at least one first coil bobbin, the at least one second coil bobbin, and the at least one third coil bobbin are configured to be independently manufactured from the plurality of core lamination pieces.

In some embodiments, the electrical system is a Sinewave filter.

In some embodiments, the electrical system is a harmonic mitigating filter.

While a number of embodiments of the present invention have been described, it is understood that these embodiments are illustrative only, and not restrictive, and that many modifications may become apparent to those of ordinary skill in the art.

What is claimed is:

1. An electrical system, comprising:

at least one three-phase inductor, comprising:

at least one core, comprising:

a plurality of stacked core laminations;

wherein the plurality of stacked core laminations comprises:

at least one first core lamination pattern and at least one second core lamination pattern;

wherein the at least one first core lamination pattern and the at least one second core lamination pattern are alternate in the plurality of stacked core laminations;

wherein the at least one first core lamination pattern comprises at least three of first laminations;

wherein the at least one second core lamination pattern comprises at least three of second laminations;

wherein at least one first lamination of the at least one first core lamination pattern and at least one second lamination of the at least one second core lamination pattern are adjacent in the plurality of stacked core laminations; and wherein the at least one first core lamination pattern and the at least one second core lamination pattern are distinct such that the at least one first lamination of the at least one first core lamination pattern and the at least one second lamination of the at least one second core lamination pattern have distinct orientations.

2. The electrical system of claim 1, wherein the at least one first lamination of the plurality of first laminations is made from at least one material selected from the group consisting of powered iron, molypermalloy, ferrite, steel, and sendust.

3. The electrical system of claim 1, wherein the at least one second lamination of the plurality of second laminations is made from at least one material selected from the group consisting of powered iron, molypermalloy, ferrite, steel, and sendust.

4. The electrical system of claim 1, wherein the electrical system is a Sinewave filter.

5. The electrical system of claim 1, wherein the electrical system is a harmonic mitigating filter.

6. The electrical system of claim 1, wherein the plurality of stacked core laminations is configured to form at least one first core segment, at least one second core segment, and at least one third core segment;

wherein the at least one three-phase inductor further comprises: at least one first coil bobbin being around the at least one first core segment, at least one second coil bobbin being around the at least one second core segment, at least one third coil bobbin being around the at least one third core segment; and wherein the at least one first coil bobbin, the at least one second coil bobbin, and the at least one third coil bobbin are configured to be independently manufactured from the plurality of stacked core laminations.

7. A three-phase inductor, comprising:

at least one core, comprising:

a plurality of stacked core laminations;

wherein the plurality of stacked core laminations comprises:

at least one first core lamination pattern and at least one second core lamination pattern;

wherein the at least one first core lamination pattern and the at least one second core lamination pattern are alternate in the plurality of stacked core laminations;

wherein the at least one first core lamination pattern comprises at least three of first laminations;

wherein the at least one second core lamination pattern comprises at least three of second laminations;

wherein at least one first lamination of the at least one first core lamination pattern and at least one second lamination of the at least one second core lamination pattern are adjacent in the plurality of stacked core laminations; and wherein the at least one first core lamination pattern and the at least one second core lamination pattern are distinct such that the at least one first lamination of the at least one first core lamination pattern and the at least one second lamination of the at least one second core lamination pattern have distinct orientations.

8. The inductor of claim 7, wherein the at least one first lamination of the plurality of first laminations is made from at least one material selected from the group consisting of powered iron, molypermalloy, ferrite, steel, and sendust.

9. The inductor of claim 7, wherein the at least one second lamination of the plurality of second laminations is made from at least one material selected from the group consisting of powered iron, molypermalloy, ferrite, steel, and sendust.

10. The inductor of claim 7, wherein the inductor is configured to be used in a Sinewave filter.

11. The inductor of claim 7, wherein the inductor is configured to be used in a harmonic mitigating filter.

12. The inductor of claim 7, wherein the plurality of stacked core laminations is configured to form at least one first core segment, at least one second core segment, and at least one third core segment;

wherein the at least one three-phase inductor further comprises: at least one first coil bobbin being around the at least one first core segment, at least one second coil bobbin being around the at least one second core segment, at least one third coil bobbin being around the at least one third core segment; and wherein the at least one first coil bobbin, the at least one second coil bobbin, and the at least one third coil bobbin are configured to be independently manufactured from the plurality of stacked core laminations.

13. A method, comprising:

installing at least one three-phase inductor, comprising:

at least one core, comprising:

a plurality of stacked core laminations;

wherein the plurality of stacked core laminations comprises:

at least one first core lamination pattern and at least one second core lamination pattern;

wherein the at least one first core lamination pattern and the at least one second core lamination pattern are alternate in the plurality of stacked core laminations;

wherein the at least one first core lamination pattern comprises at least three of first laminations;

wherein the at least one second core lamination pattern comprises at least three of second laminations;

wherein at least one first lamination of the at least one first core lamination pattern and at least one second lamination of the at least one second core lamination pattern are adjacent in the plurality of stacked core laminations; and wherein the at least one first core lamination pattern and the at least one second core lamination pattern are distinct such that the at least one first lamination of the at least one first core lamination pattern and the at least one second lamination of the at least one second core lamination pattern have distinct orientations.

14. The method of claim 13, wherein the at least one first lamination of the plurality of first laminations is made from at least one material selected from the group consisting of powered iron, molypermalloy, ferrite, steel, and sendust.

15. The method of claim 13, wherein the at least one second lamination of the plurality of second laminations is made from at least one material selected from the group consisting of powered iron, molypermalloy, ferrite, steel, and sendust.

16. The method of claim 13, wherein the inductor is configured to be used in a Sinewave filter.

17. The method of claim 13, wherein the inductor is configured to be used in a harmonic mitigating filter.

18. The method of claim 13, wherein the plurality of stacked core laminations is configured to form at least one first core segment, at least one second core segment, and at least one third core segment;

wherein the at least one three-phase inductor further comprises: at least one first coil bobbin being around the at least one first core segment, at least one second coil bobbin being around the at least one second core segment, at least one third coil bobbin being around the at least one third core segment; and wherein the at least one first coil bobbin, the at least one second coil bobbin, and the at least one third coil bobbin are configured to be independently manufactured from the plurality of stacked core laminations.

* * * * *